United States Patent [19]

Rueben

[11] Patent Number: 4,882,096

[45] Date of Patent: Nov. 21, 1989

[54] COMPACT HAND-PORTABLE HUMIDIFIER

[76] Inventor: Ronnie Rueben, c/o 555 Chabanel W., Montreal, Quebec, Canada

[21] Appl. No.: 270,666

[22] Filed: Nov. 14, 1988

[51] Int. Cl.[4] ..... B01F 3/04

[52] U.S. Cl. ..... 261/30; 261/81; 261/DIG. 48; 239/102.2

[58] Field of Search ..... 239/102.2; 261/DIG. 48, 261/81, 30

[56] References Cited

U.S. PATENT DOCUMENTS

| | | | |
|---|---|---|---|
| 4,087,495 | 5/1978 | Umehara | 261/DIG. 48 |
| 4,699,737 | 10/1987 | Engstrand | 261/120 |
| 4,719,057 | 1/1988 | Mizoguchi | 261/DIG. 48 |
| 4,746,466 | 5/1988 | Takahashi | 261/DIG. 48 |
| 4,752,422 | 6/1988 | Uchida et al. | 261/DIG. 48 |

*Primary Examiner*—Tim Miles

[57] ABSTRACT

A compact hand-portable vapor dispenser device comprising a miniature support housing capable of being carried in a small article of luggage, such as an attache case, and having a reservoir attachment for securement to a water reservoir. A dispensing valve is provided in the reservoir to dispense water to a vaporizing chamber having a vapor release nozzle. An ultrasonic vibrating element is provided in the vaporizing chamber. A transducer circuit is provided for driving the vibrating element and a convection port is positioned in communication with the vaporizing chamber to release water vapor through a vapor orifice. A fan convects air for release through the port. A power supply is connected to an electronic drive circuit located in the housing.

11 Claims, 4 Drawing Sheets

COMPACT HAND-PORTABLE HUMIDIFIER

BACKGROUND OF INVENTION

1. Field of Invention

The present invention relates to a compact hand-portable vapor dispenser device capable of being carried in an article of luggage, such as an attache case, and which utilizes an ultrasonic vibrator as a vaporizing element to break down water globules into micro particles which are then released into the atmosphere by a jet through an orifice.

2. Description of Prior Art

Various constructions of humidifiers are known, but the majority of these are not hand-portable in the sense that a person can carry the humidifier device in a small article of luggage, such as an attache case, a purse, or tucked away in a conventional luggage. It is common nowadays to heat air conditioned rooms with electric-type heaters and air conditioners. A disadvantage of such units is that they do not release humidity in the air and provide dry heat thereby drying up the air in a room and making it uncomfortable to breathe and hence making it difficult to sleep. It is also known that there are advantages in having a certain degree of humidity in the air for health reasons, particularly to those persons who suffer from breathing disorders.

Small humidifying devices such as vaporizers are known wherein an electrical resistive element is provided in a reservoir filled with water, and wherein the water is boiled and released as steam. However, such elements are still fairly bulky and cannot be conveniently carried in a small article of luggage, such as in an attache case.

SUMMARY OF INVENTION

It is a feature of the present invention to provide a compact hand-portable humidifier which substantially overcomes all of the above-mentioned disadvantages of the prior art.

Another feature of the present invention is to provide a compact hand-portable humidifier which comprises a compact housing on which a collapsible reservoir may be connected and wherein the housing and the reservoir are supported by a collapsible support frame integrated with the housing.

Another feature of the present invention is to provide a compact hand-portable humidifier which utilizes an ultrasonic vibrator as a source for generating minute water particles which are ejected into the atmosphere through a nozzle by means of an air stream created by a fan incorporated in the device.

Another feature of the present invention is to provide a compact hand-portable humidifier comprising a miniature support housing and a collapsible water reservoir connectable thereto and wherein the housing is provided with an electronic drive circuit.

Another feature of the present invention is to provide a compact hand-portable humidifier which is efficient, easy to use, and which may be carried in an attache case.

According to the above features, from a broad aspect, the present invention provides a compact hand-portable vapor dispenser device which comprises a miniature support housing capable of being carried in an article of luggage, such as an attache case, and which has reservoir attachment means for securing a water reservoir thereto. Valve means is provided for dispensing water from the reservoir to a vaporizing chamber associated with an ultrasonic vibrating means. Water particles are released by the vibrating means and ejected in the atmosphere through a nozzle. Transducer circuit means is provided for driving the vibrating means. A fan convects air into the vaporizing chamber for releasing water vapor through the nozzle. A power supply is connected to an electric drive circuit which is located in the housing for driving the ultrasonic vibrating means and the fan.

BRIEF DESCRIPTION OF DRAWINGS

A preferred embodiment of the present invention will now be described with reference to the example thereof as illustrated in the accompanying drawings in which.

DESCRIPTION OF PREFERRED EMBODIMENTS

Figure 1:
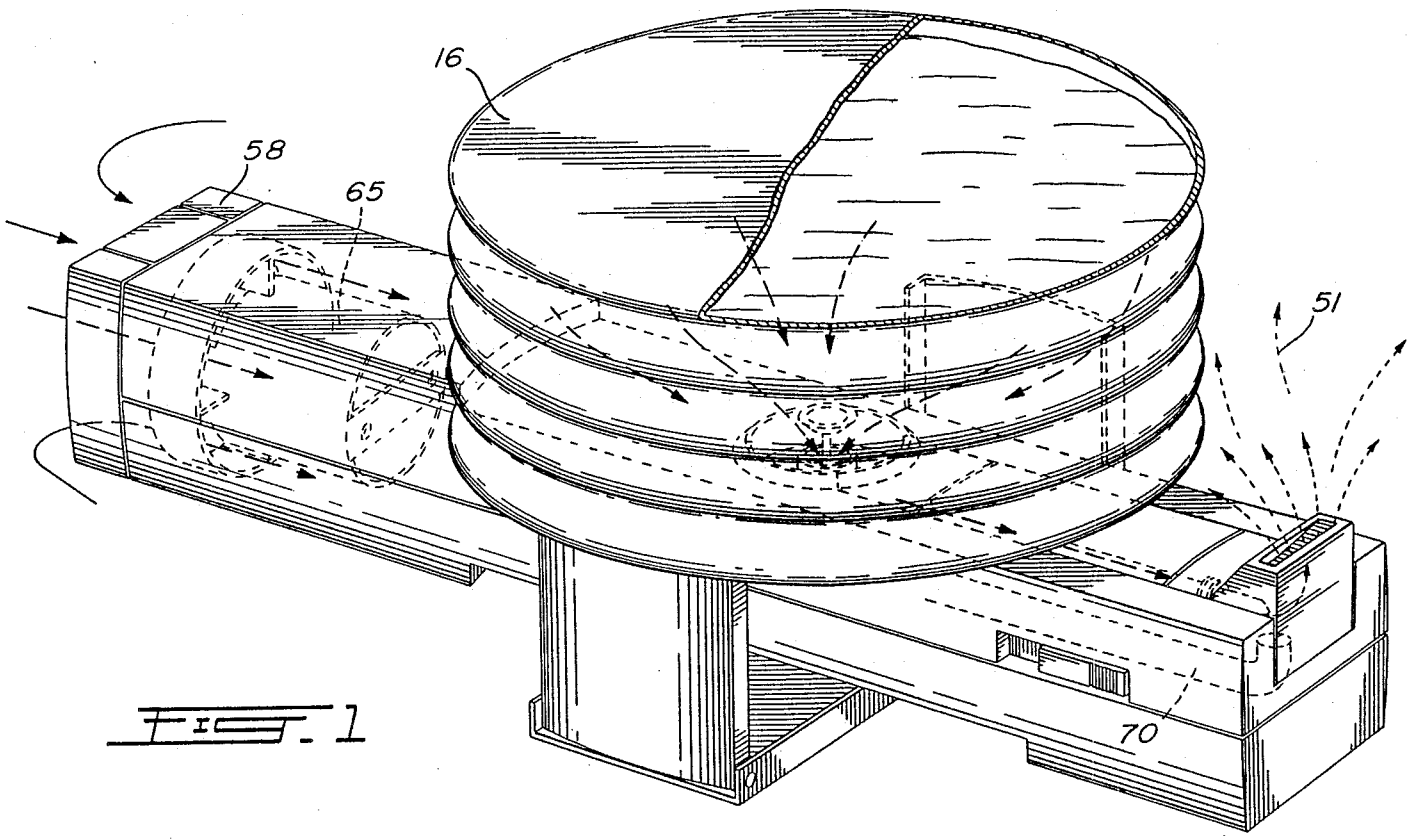
FIG. 1 is a perspective view of the compact hand-portable vapor dispenser device of the present invention and accessories.

Referring to the drawings, and more particularly to FIG. 1, there is shown generally at 10 the compact hand-portable vapor dispenser device of the present invention. As herein shown, the device comprises a miniature support housing 11 which is of hand-portable size and capable of being carried in an article of luggage, such as an attache case. A reservoir attachment means in the form of a reservoir connecting cavity 12 is located in a top wall 13 of the housing, and is adapted to receive a reservoir attachment means in the form of a dispensing connector 14 protruding from a bottom wall 15 of a collapsible reservoir 16.

A vaporizing chamber or housing 17 is positioned in communication with the reservoir connecting cavity 12, through orifice 12', to receive water therein. At an opposed end of the device there is provided a vapor release orifice 18, through which vapor is released into the atmosphere. A power supply in the form of an AC/DC converter 19 is provided and has a connecting plug 20 to supply the various electrical driven components of the vapor dispenser device 10, as will be described later.

Figure 2:
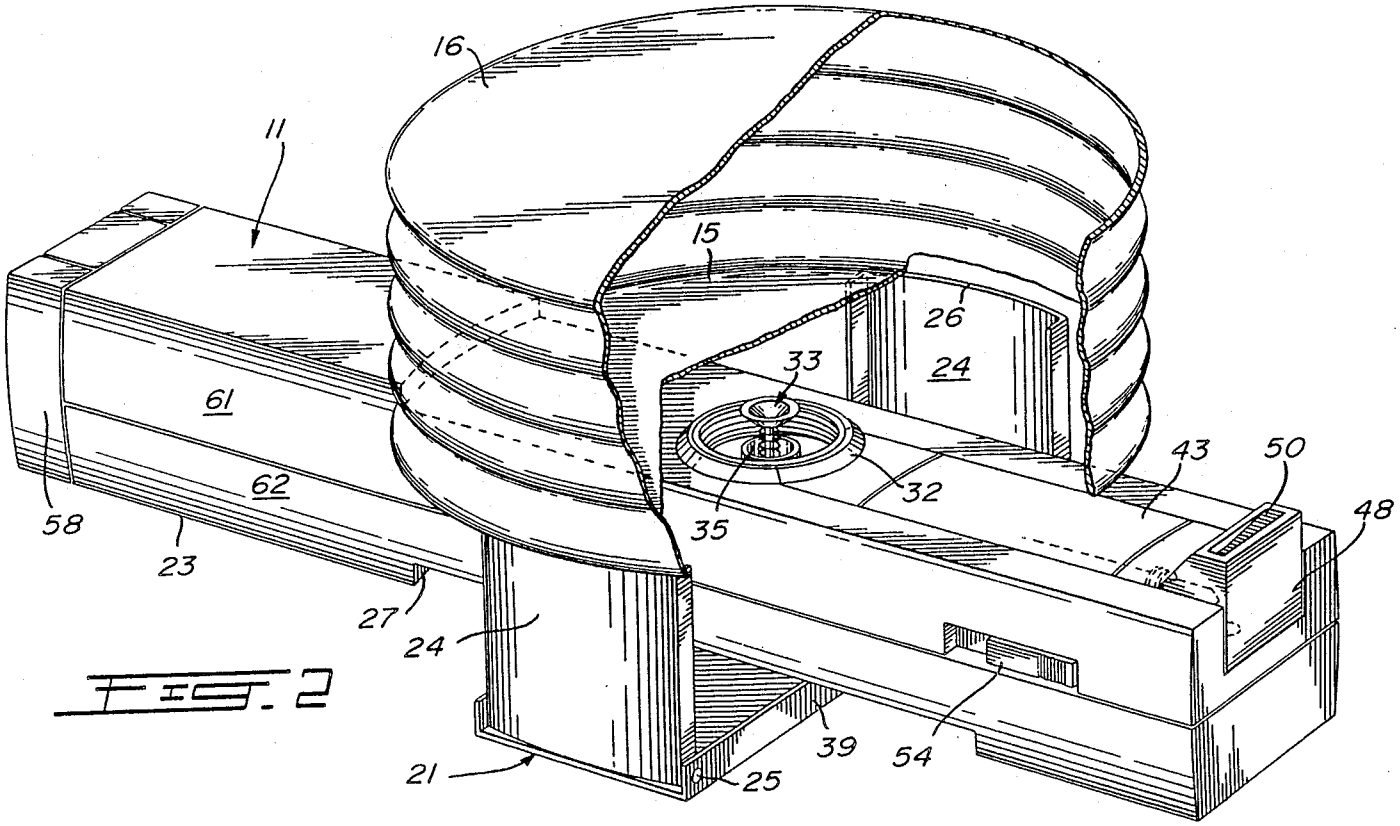
FIG. 2 is a perspective view showing the compact hand-portable dispenser device in its position of use.
Figure 3:
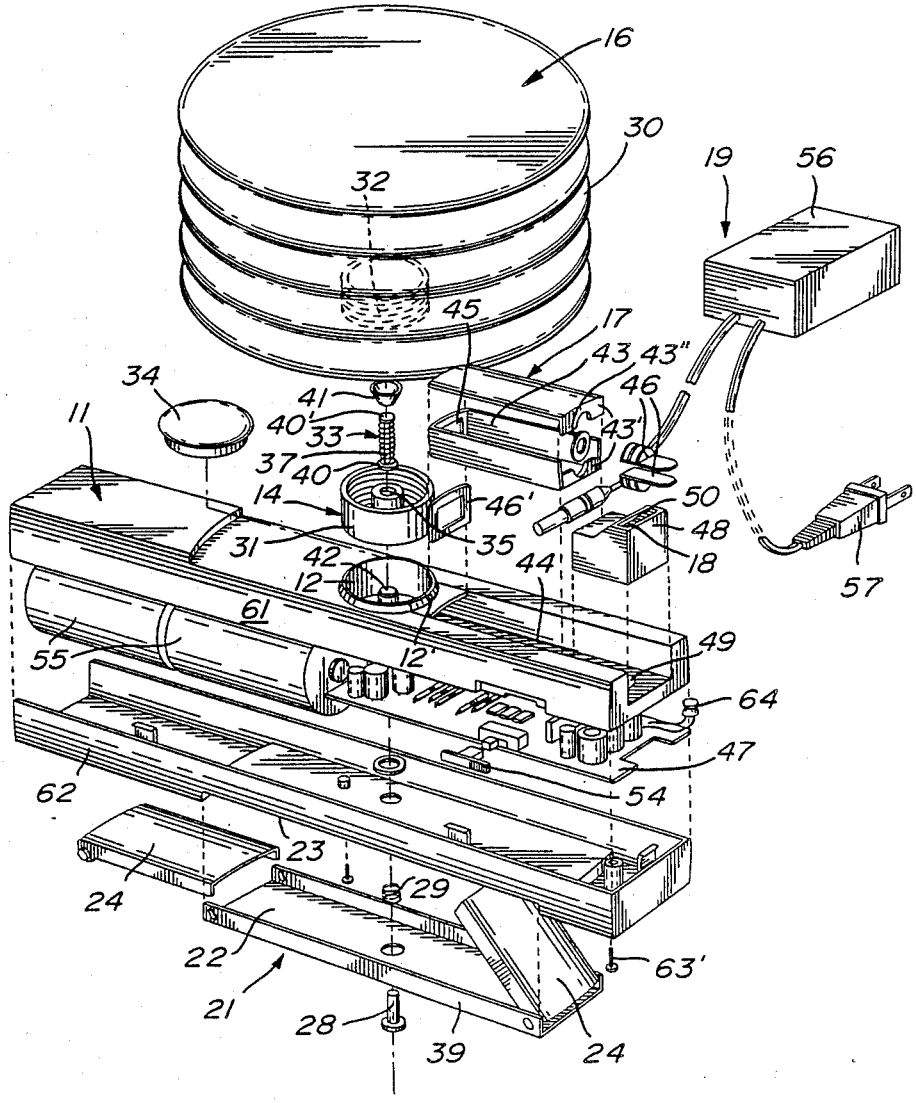
FIG. 3 is an exploded view of the compact hand-portable dispenser device.

Referring now additionally to FIGS. 2 and 3, it can be seen that the support housing is an elongated substantially rectangular slender housing and is provided with support means in the form of a collapsible support frame 21 which is secured to and integrated with a housing wall and collapsible from a position of use, as shown in FIG. 1, wherein the frame supports the reservoir 16, to a storage position, wherein the support frame is integrated with the housing 11.

The support frame 21 comprises a pivotal bottom support arm 22 which is pivotally secured to a bottom wall 23 of the housing 11 and is provided with a hinge end support flange 24 at opposed ends thereof. The pivotal support arm 22 when in its position of use, as shown in FIG. 2, is disposed substantially transverse to the housing 11 with each of the end flanges 24 extending vertically on their hinge pins 25 and their free upper end 26 engaged under a respective opposed end of the bottom wall 15 of the water reservoir 16.

When not in use the pivotal bottom support arm and end flanges are collapsed and disposed in a locating cavity 27 provided in the housing bottom wall 23. A spring biased pivot pin is secured centrally of the pivoted bottom support arm to permit the support arm to be drawn out of the locating cavity 27 against the spring force of spring 29 which brings the side walls 39 of the support arm 22 against the bottom wall 23 of the housing to hold it rigidly thereagainst, and to provide a cross-like support for the reservoir 15 when the housing is positioned on a tabletop or a like support surface. As shown in FIG. 3 the end flanges 24 fold inwardly onto the bottom support arm 22 on a respective side thereof and between the side edge walls 39. Thus, the collapsible support frame 21 is integrated into the housing 11 and disposed flush with the housing walls when positioned in the cavity 27.

As can be seen, the reservoir 16 is an expandable reservoir provided with a rigid bottom wall 15 to which is secured an accordion side wall 30. The dispensing connector 14 is formed as a knob 31 which has an inner thread, which is threadably secured to a ring member 32 disposed centrally of the bottom wall 15. The knob 31 is unscrewed to fill the reservoir with water.

Figure 4A:
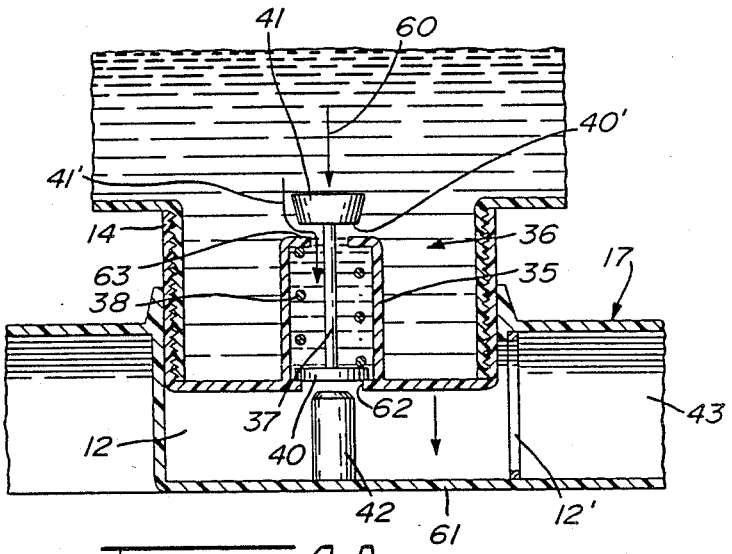
FIGS. 4A and 4B are section views of the water dispensing valve of the reservoir.
Figure 4B:
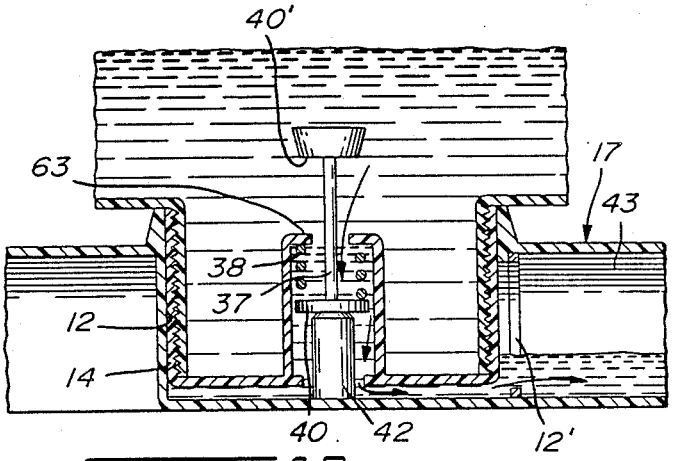

A regulating dispensing valve 33, see FIG. 4, is secured to and disposed inwardly of the dispensing connector 14. The connector 14 is dimensioned to be received in the connecting cavity 12 formed in the top wall of the housing 11, as shown in FIGS. 4A and 4B. When the reservoir is not connected to the cavity 12, a cap 34 seals off the cavity 12 and is press-fitted thereto.

The dispensing connector 14 has an outlet port 35 therein and in which a float valve regulator 36 is positioned. The float valve regulator consists of a pin 37 having a spring 38 thereabout maintained between opposed end heads 40. A rubber cone 41 is disposed about the top head 40' extending therethrough.

As shown in FIGS. 4A and 4B, the valve is maintained closed by water pressure in the direction of arrow 60 on the cone 41 maintaining the lower head 40 seated on peripheral wall 61 of the dispensing opening 62. When the connector 14 is disposed in the cavity 12 the actuating post 42 lifts the valve 36 off its bottom seat causing water to flow through the opening 62 about the post 42 and into the vaporizing chamber 17 through orifice 12'. Water from the reservoir enters around a top ring 63 and flows down around the pin 37, as shown at 41' and water drips into the reservoir connecting cavity 12 at a rate of 200–300 cc/hr. The bottom flange 40 of the pin rests on the actuating post 42 and the water drips around the post. When the water level falls below the ring 63, the reservoir is substantially empty. The spring 38 is compressed between the ring 63 and the lower head 40. When the reservoir is lifted, the spring 38 closes the valve.

The vaporizing chamber 17 comprises a water trough 43 located in a channel 44 provided in the top wall of the device and adjacent the reservoir connecting cavity 12 and has an open end wall 45 provided with a sealing ring 46' and through which water is admitted into the trough 43. An ultrasonic vibrating element, in the form of a pair of vibrating copper nibs 46 is secured in the end wall 43' of the trough 43 and a washer 43'' provides a seal therearound. The nibs 46 extend in the housing 48 and are driven at high frequency by a driver circuit provided on a circuit board 47. The nibs 46 vibrate at an ultrasonic frequency to break down water particles directed between the nibs. The water particles are released in a nozzle housing 48 in which the ultrasonic vibrating nibs 46 project. A hole 49 is provided in the bottom wall of the cavity 44 and communicate with a convection conduit 70 disposed thereunder. A fan 65 is secured at one end of the housing and forces air into the conduit 70. The hole 49 is aligned with the nozzle housing 48 and water particles, broken down by the ultrasonic vibrator, are ejected out of the nozzle housing 48 through a vapor release orifice 50 to release water vapor 51 into the atmosphere (see FIG. 1).

A circuit board 47 is provided with various electronic components thereon and includes an electronic drive circuit which is conveniently housed withing the housing 11. A switch 54 connects the power source 19 to the printed circuit board 49 to drive the ultrasosnic vibrator nibs and the fan and any other elements associated with the electronic circuit.

The AC source has an AC/DC converter 19 which is a transformer device located within the portable housing 56. An electrical plug 57 connects the transformer to an AC outlet (not shown). A battery cover or end plate 58 provides access to the fan 65 at the end of the housing 11. Also, the housing 11 is sectioned along the longitudinal axis to provide an elongated top section 61 and an elongated bottom section 62 secured together by suitable securing means, such as screws 63'. The housing may be constructed of plastics material or any suitable material and may also be secured together by snap connectors, as is well known in the art.

It is within the ambit of the present invention to cover any obvious modifications of the example of the preferred embodiment described herein, provided such modifications fall within the scope of the appended claims.

I claim:

1. A compact hand-portable vapor dispenser device comprising a miniature support housing capable of being carried in an article of luggage, said support housing being an elongated substantially rectangular housing having a reservoir connector on a top wall thereof for connecting to a reservoir, valve means for dispensing water from said reservoir to a vaporizing chamber provided in said housing, an ultrasonic vibrating means in said vaporizing chamber for producing and releasing water particles, said vaporizing chamber having a nozzle through which said water particles are ejected into the atmosphere, transducer circuit means for driving said vibrating means, a fan in said housing to provide air under pressure to said vaporizing chamber and in communication with said vibrating means for releasing water vapors through said nozzle, a collapsible support frame secured to said housing and collapsible from a position of use where said frame supports said reservoir to a storage position where said frame is integrated with said housing, and a power supply connected to an electronic circuit located in said housing for driving said ultrasonic vibrating means and fan.

2. A vapor dispensing device as claimed in claim 1 wherein said collapsible support frame comprises a pivotal bottom support arm pivotally secured to a bottom wall of said housing and having a hinge end flange at opposed ends thereof, said pivotal bottom support arm when in said position of use extending substantially transverse to said housing with each end flange disposed vertically with their free upper end engaged under a respective opposed end of a bottom wall of said reservoir.

3. A vapor dispensing device as claimed in claim 2 wherein said pivotal bottom support arm is located in a locating cavity in said housing bottom wall and a spring biased pivot pin secured centrally of said pivoted bottom support arm to permit said support arm to be drawn out of said locating cavity against a spring force exerted by said spring biased pivot pin.

4. A vapor dispensing device as claimed in claim 3 wherein each support arm hinges inwardly against an inner wall of said support arm, said support arm having opposed side walls terminating flush with the side wall of said housing so that said support arm substantially conceals said locating cavity and is integrated with said support housing.

5. A vapor dispensing device as claimed in claim 1 wherein said reservoir is a collapsible reservoir having a rigid bottom wall and an accordion side wall, and a dispensing connector for supplying water from said reservoir to said vaporizing chamber.

6. A vapor dispensing device as claimed in claim 5 wherein said valve means is a water pressure operated dispenser valve secured to said dispensing connector to seal water in said reservoir, said attachment means being a connecting cavity in said housing top wall, said dispensing connector having a projection extending out of said reservoir bottom wall and dimensioned to be received in said connecting cavity, said connecting cavity having an actuating post therein to open said valve to cause water to flow out of said reservoir and into said vaporizing chamber through a communicating opening in said connecting cavity and dispensing a controlled quantity of water in said vaporizing chamber.

7. A vapor dispensing device as claimed in claim 6 wherein said vaporizing chamber is removably received in a top wall cavity of said housing adjacent said connecting cavity, said vaporizing chamber having a water chamber section in communication with said top wall cavity for receiving water therein, said ultrasonic vibrating means being secured to an end wall of said water chamber section and projecting into a dispensing nozzle housing.

8. A vapor dispensing device as claimed in claim 7 wherein said ultrasonic vibrator comprises a pair of closely disposed nib plates which re vibrated at ultrasonic frequency by said driving circuit forming part of said electronic drive circuit.

9. A vapor dispensing device as claimed in claim 8 wherein there is further provided a convection channel and port in communicating with said nozzle and said fan, said nozzle having said vapor release orifice disposed in a top wall thereof adjacent said ultrasonic nib plates, said fan being disposed at a remote end of said housing.

10. A vapor dispensing device as claimed in claim 1 wherein said power supply is an AC/DC converter transformer connectable to said electronic drive circuit through a switch.

11. A vapor dispensing device as claim in claim 1 wherein said housing has an elongated top and bottom section connected together, and a removable end wall cover for access to a fan compartment in an end section of said housing.

* * * * *